US005299844A

United States Patent [19]

Gleason

[11] Patent Number: 5,299,844

[45] Date of Patent: Apr. 5, 1994

[54] SEALED LATCH ASSEMBLY

[75] Inventor: Stephen J. Gleason, Charles City, Iowa

[73] Assignee: Tri/Mark Corporation, New Hampton, Iowa

[21] Appl. No.: 969,440

[22] Filed: Oct. 30, 1992

[51] Int. Cl.[5] ..... E05C 3/02

[52] U.S. Cl. ..... 292/240; 292/DIG. 31

[58] Field of Search ..... 292/240, DIG. 31, 216, 292/194, 200, 211, 254, DIG. 45, 210, 330

[56] References Cited

U.S. PATENT DOCUMENTS

| | | | |
|---|---|---|---|
| 2,621,952 | 12/1952 | Gander | 292/DIG. 31 X |
| 2,722,445 | 11/1955 | Cudney | 292/DIG. 31 X |
| 2,763,503 | 9/1956 | Tasch et al. | 292/DIG. 31 X |
| 3,993,338 | 11/1976 | Cherbourg et al. | 292/DIG. 31 X |
| 4,309,884 | 1/1982 | Davis | 292/DIG. 31 X |
| 4,320,642 | 3/1982 | Pastva, Jr. | 292/DIG. 31 X |
| 4,438,964 | 3/1984 | Peters | 292/DIG. 31 X |
| 4,911,487 | 3/1990 | Rachocki | 292/216 |
| 4,969,916 | 11/1990 | Weinerman et al. | 292/DIG. 31 X |
| 5,042,853 | 8/1991 | Gleason et al. | 292/126 |
| 5,095,659 | 3/1992 | Benoit et al. | 292/DIG. 31 X |

*Primary Examiner*—Rodney M. Lindsey
*Attorney, Agent, or Firm*—Wood, Phillips, VanSanten, Hoffman

[57] ABSTRACT

A latch assembly for releasably holding a strike element. The latch assembly has a release lever, a housing with a body defining a receptacle for the release lever and having a wall bounding the receptacle, structure for mounting the release lever to the housing for movement relative to the housing between a) a normal position and b) a release position, a latch mechanism on the housing for cooperating with a strike element and movable selectively relative to the housing between a) a latched position wherein the latch position will hold a strike element and b) an unlatched position wherein a strike element held by the latch mechanism with the latch mechanism in its locked position can be released from the latch mechanism, and structure operatively connecting between the release lever and the latch mechanism for moving the latch mechanism from its latched position into its unlatched position as an incident of the release lever moving from its normal position into its release position. The connecting structure includes a leg extending through an opening in the body. The leg has an associated shoulder. Structure is provided for sealing the opening to avoid the passage of foreign matter through the body opening. The sealing structure has at least a portion that is located between the shoulder on the leg and the body with the release lever in at least one of the normal and release positions.

20 Claims, 2 Drawing Sheets

SEALED LATCH ASSEMBLY

BACKGROUND OF THE INVENTION

1. Field of the Invention

This invention relates to a latch assembly as commonly placed on hinged doors, for releasably holding a strike element on a frame relative to which the door is hinged and, more particularly, to the structure for preventing migration of rain and other foreign matter through the latch assembly and into a door on which the latch assembly is mounted.

2. Background Art

Paddle-operated latch assemblies are well known in the prior art. An exemplary latch assembly is shown in U.S. Pat. No. 5,042,853 (the "'853 patent"), to Gleason et al., assigned to the assignee hereof. This type of latch assembly has application in numerous different environments, for example on motor homes, tool boxes, etc.

One problem that has plagued the art is that of avoiding migration of rain and other foreign matter from externally of the door, with which the latch assembly is associated, through the latch assembly and to the inside of the door. As can be seen in the '853 patent, an opening 55 is provided in the housing 30 to allow interconnection of the external paddle 28 to the internal operating mechanism. The opening 55 affords a passageway for foreign matter through the housing 20 to within a door on which the latch assembly is mounted. The paddle 28 provides some shielding to the opening 55, however, driving rain may still funnel upwardly into the opening 55.

One manufacturer of latch assemblies adheres a rubber sheet over the opening in the forwardly facing wall of a housing. The rubber sheet is cut out to accommodate the operating mechanism. However, a substantial opening is provided in the rubber sheet and thus foreign matter is free to migrate through the latch assembly.

SUMMARY OF THE INVENTION

The present invention is specifically directed to overcoming the above problem in a novel and simple manner.

More particularly, according to the invention, a latch assembly is provided for releasably holding a strike element. The latch assembly has a release lever, a housing with a body defining a receptacle for the release lever and having a wall bounding the receptacle, structure for mounting the release lever to the housing for movement relative to the housing between a) a normal position and b) a release position, a latch mechanism on the housing for cooperating with a strike element and movable selectively relative to the housing between a) a latched position wherein the latch position will hold a strike element and b) an unlatched position wherein a strike element held by the latch mechanism with the latch mechanism in its locked position can be released from the latch mechanism, and structure operatively connecting between the release lever and the latch mechanism for moving the latch mechanism from its latched position into its unlatched position as an incident of the release lever moving from its normal position into its release position. The connecting structure includes a leg extending through an opening in the body. The leg has an associated shoulder. Structure is provided for sealing the opening to avoid the passage of foreign matter through the body opening. The sealing structure has at least a portion that is located between the shoulder on the leg and the body with the release lever in at least one of the normal and release positions.

In one form, the housing is a cup-shaped receptacle to receive the release lever. The opening in the housing to accommodate the leg is in the forwardly facing wall which bounds the receptacle.

In one form, the sealing structure is a gasket that is compressed between the shoulder on the leg and the body with the release lever in its normal position. Accordingly, a positive seal can be maintained at the point of the gasket, which can partially or fully overlie the body opening.

The sealing structure is made from a foam material or other compressible material that affords a good seal. The sealing structure can extend partially, and preferably completely, around the leg.

The gasket is preferably attached to at least one of the leg, the release lever and the housing. In one form, the gasket is compressed between a rearwardly facing shoulder on the leg and a forwardly facing wall of the body.

The leg can be made unitary with the release lever to follow movement of the release lever as the release lever moves between its normal and release positions. In one form, the release lever and leg are formed as one piece.

The leg moves in a prescribed path as the release lever moves between its normal and release positions. The body wall opening is substantially matched to the path of the leg where the leg coincides with the body wall as the release lever moves between its normal and release position. In one form, the path is substantially straight and extends in a first line and the body wall opening is substantially rectangular with a longer and shorter dimension, with the longer dimension aligned with the first line.

In one form, the shoulder is elongate and bridges the longer dimension of the opening.

The shoulder may also serve the dual purpose of abutting the body to limit movement of the release lever as it moves from its release position into its normal position.

In one form, the release lever is mounted to the housing for pivoting movement about a first axis. The connecting structure can include a pivot plate that is pivotable between first and second positions about a second axis that is transverse to the first axis. The leg may act directly against the pivot plate.

A locking mechanism can be provided on the body to selectively block the pivot plate in one of the first and second positions.

DETAILED DESCRIPTION OF THE DRAWINGS

Figure 1:
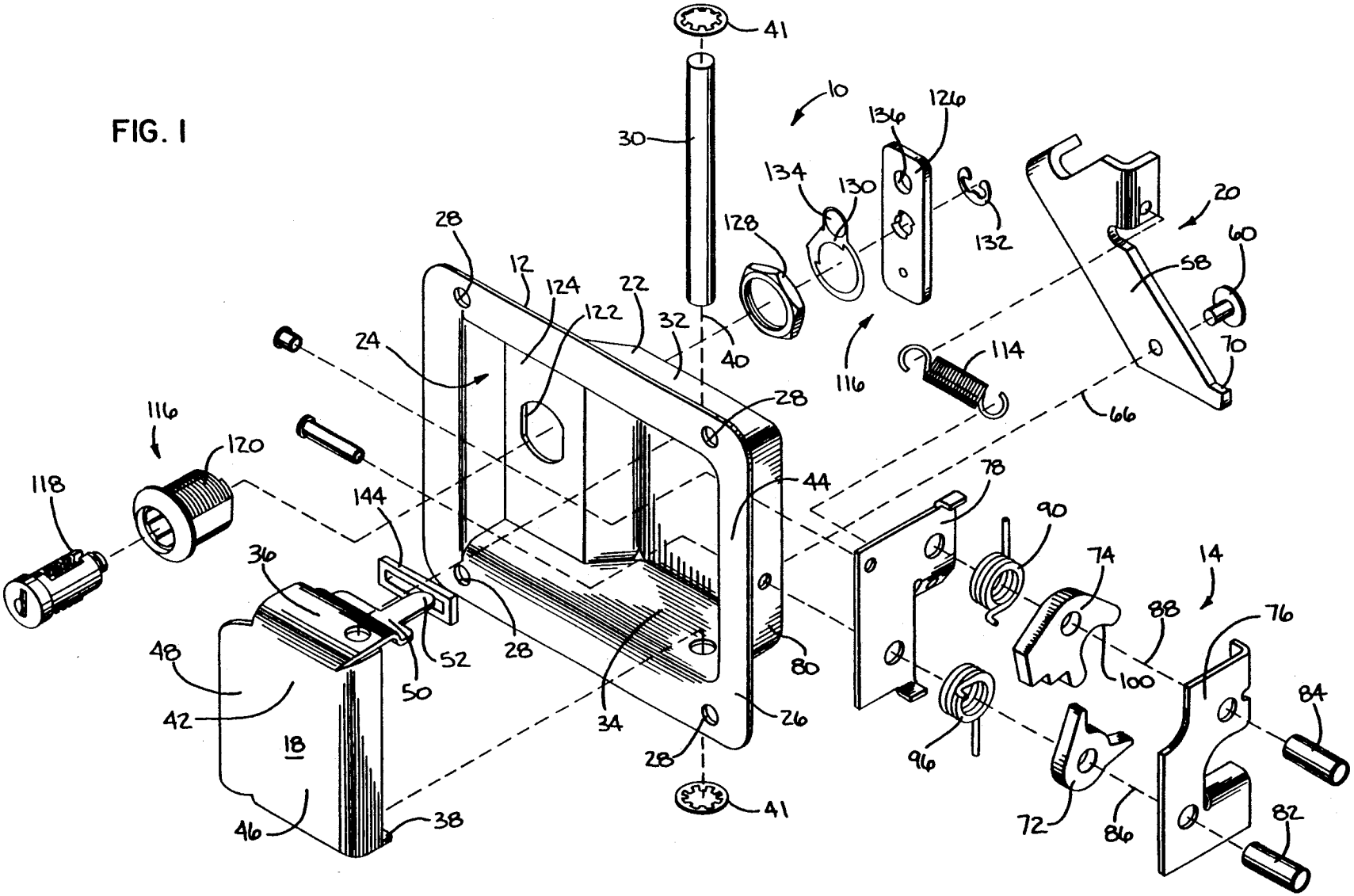
FIG. 1 is an exploded perspective view of a latch assembly with sealing structure according to the present invention.

A preferred form of latch assembly, according to the present invention, is shown at 10 in FIGS. 1-6. The latch assembly 10 consists of a housing 12 onto which are mounted a releasable latch means 14 for a strike element 16 (FIG. 5), a release lever 18 in the form of a paddle, and means at 20 for operatively connecting between the release lever/paddle 18 and the latch means 14.

The housing 12 has a body 22 defining a cup-shaped receptacle 24 for the release lever/paddle 18. The body 22 has an integrally formed, outturned flange 26 around the periphery of the receptacle with mounting holes 28 therein to facilitate connection of the housing 12 to a hinged door (not shown) as by the use of screws or bolts.

The release lever/paddle 18 has, in vertical section, a generally U-shaped configuration. A hinge pin 30 extends into facing walls 32, 34 on the body 22 and through the legs 36, 38 of the release lever/paddle 18 to thereby maintain the release lever/paddle 18 in operative position within the receptacle 24 for pivoting movement about the axis 40 of the hinge pin 30. Lock washers 41 maintain the pin 30 on the body 22. The release lever/paddle 18 is pivotable between a normal position, wherein the forwardly facing surface 42 thereof is substantially flush with the forwardly facing surface 44 of the flange 26, and a release position, wherein the release lever/paddle 18 is pivoted from the FIG. 1 orientation in a counterclockwise direction, when viewed from overhead.

The release lever/paddle 18 is preferably formed from a single piece of sheet metal. The legs 36, 38 are bent at right angles to the body 46. An upturned flange 48 facilitates manipulation of the release lever/paddle 18 by the user by providing a readily accessible portion to be grasped and drawn outwardly to pivot the release lever/paddle 18. The leg 36 extends continuously into a T-shaped leg 50 having a portion 52 extending in cantilever fashion through an opening 54 in the back, forwardly facing wall 56 on the body 22.

Figure 2:
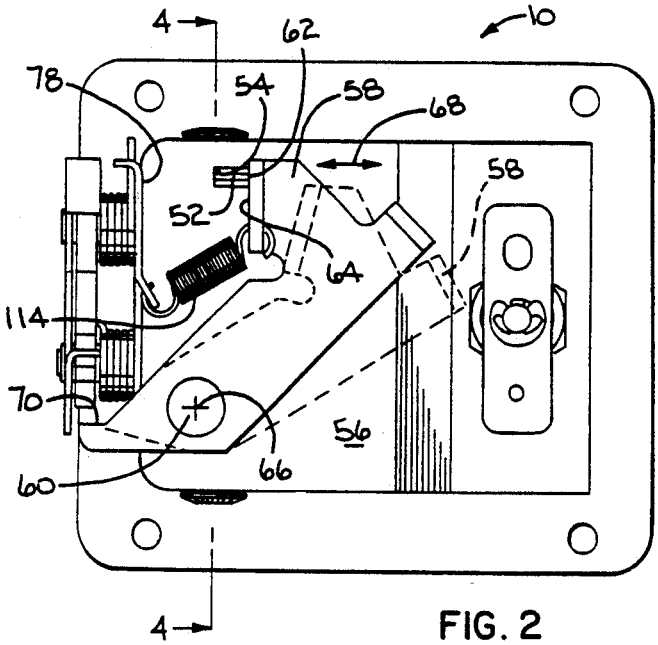
FIG. 2 is a rear elevation view of the latch assembly shown in a latched and unlocked position.
Figure 4:
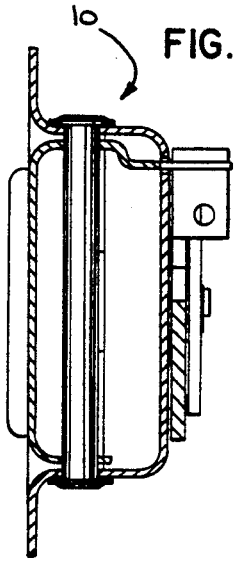
FIG. 4 is a cross-sectional view of the latch assembly taken along line 4—4 of FIG. 2.
Figure 3:
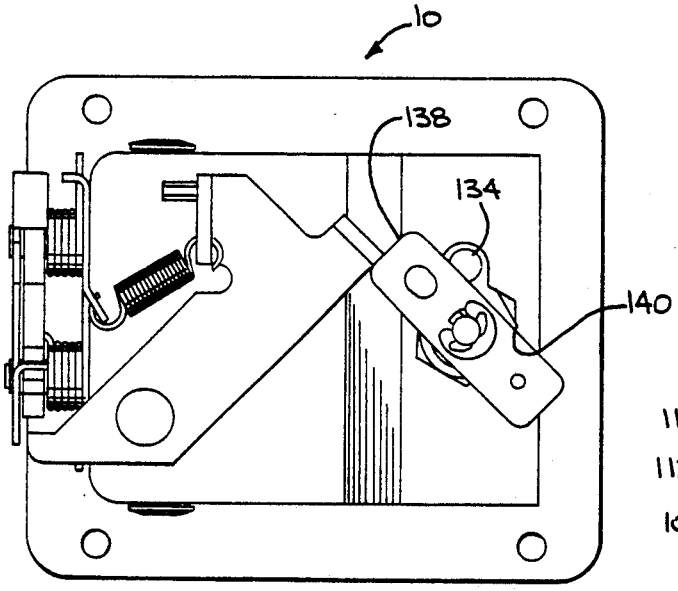
FIG. 3 is a view as in FIG. 2 with the latch assembly locked.
Figure 5:
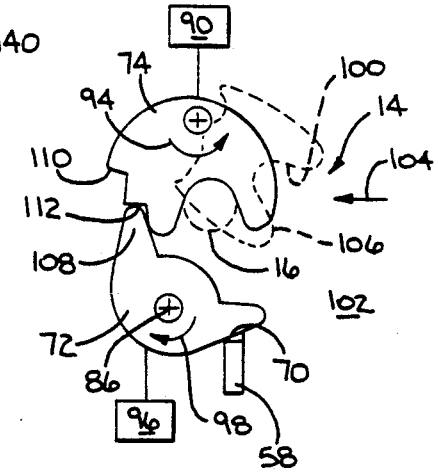
FIG. 5 is an isolated, side elevation view of the latch mechanism on the latch assembly to releasably hold a strike element.
Figure 6:
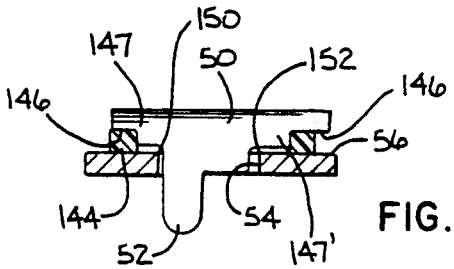
FIG. 6 is a cross-sectional view of sealing structure for a slightly modified form of leg extending through a housing on the latch assembly.

The leg portion 52 acts directly against a pivot plate 58 that is held to the wall 56 by a rivet 60 that permits pivoting movement of the pivot plate 58 from a first solid line position in FIG. 2 to a second position, shown in phantom in FIG. 2.

The arm portion 52 has an edge 62 that bears against a wall 64 at a location spaced from the pivot axis 66 for the pivot plate 58. As the release lever/paddle 18 is moved from its normal position to its release position, the edge 62 moves in the line of double-headed arrow 68 from left to right in FIG. 2. This effects a clockwise movement of the plate 58 about the pivot axis 66 to bear an actuating shoulder 70 on the pivot plate 58 against a cam element 72 on the latch means 14. The cam element 72 cooperates in turn with a latch element 74 that selectively holds and allows release of the strike element 16.

More particularly, the cam element 72 and latch element 74 are mounted in operative position between mounting plates 76, 78 attached to the side wall 80 of the body 22. The plates 76, 78 are maintained in spaced relationship by mounting posts 82, 84 which extend through the cam element 72 and latch element 74, respectively, to support the cam element 72 and latch element 74 for rotation about parallel axes 86, 88. A coil spring 90 normally biases the latch element 74 in the direction of arrow 94 in FIG. 5. A coil spring 96 biases the cam element 72 in the direction of arrow 98 around its axis 86.

The latch means 14 is movable between a latched position and an unlatched position. In the unlatched position, a curved seat 100 defined by the latch element 74 opens towards the strike element 16 on a frame 102 relative to which the door (not shown) and attached latch assembly 10 hinge. As the door is moved from its open position towards its closed position, the strike element 16 moves in the direction of arrow 104 and encounters the edge 106 of the latch element 74 bounding the seat 100. Further closing pressure on the door causes the strike element 16 to urge the latch element 74 against the bias of the spring 90 in a clockwise direction in FIG. 4. As this occurs, a nose 108 on the cam element 72 is biased by the spring 96 first against one step 110 on the latch element 74 and then against a second step 112 as shown in solid lines in FIG. 4 as rotation of the latch element 74 continues. This represents the latched position for the latch means 14.

In the latched position, the U-shaped seat 100 opens downwardly receives the strike element 16, and holds the strike element 16 to thereby maintain a door with the latch assembly 10 thereon in a closed position. The latch element 74 can only be released from its latched position to the phantom position in FIG. 4 by repositioning the cam element 72. This is accomplished through movement of the pivot plate 58 from its first position into its second position which thereby urges the cam element 72 against the force of the spring 96 to allow the nose 108 to move out of the path of the shoulders 110, 112 and allow the latch element 74 to pivot in the direction of the arrow 94 to the phantom position.

A coil spring 114 connects between the pivot plate 58 and mounting plate 78 to normally urge the pivot plate 58 to the first, solid line position in FIG. 2.

A lock means is provided at 116 to selectively maintain the pivot plate 58 in the first position therefor to prevent movement of the pivot plate 58 from its first position into its second position and as an incident thereto the latch means from moving from its latched position into its unlatched position. A keyed tumbler 118 is received in a cylinder 120 which is in turn keyed within an opening 122 to a stepped wall 124 on the body 22. The tumbler 118 projects through the housing 12 to be operatively connected with a blocking plate 126. A nut 128 threaded to the cylinder 120 maintains the cylinder 120 in operative relationship on the housing 12. A detent ring 130 is also carried on the cylinder 120 and is maintained in place by the blocking plate 126 which is in turn held in place by a C-ring 132 connected to the end of the tumbler 118.

The detent ring 130 has a dimple 134 thereon that moves into an opening 136 in the blocking plate 126 with the blocking plate 126 in the "off" position shown in FIG. 2. Through a key (not shown) the tumbler 118 is movable to situate the blocking plate 126 in the "on" position of FIG. 3 in which an edge 138 thereon blocks the pivot plate 158 in the first position therefor. The off position is consistently located by a shoulder 140 on the ring 130 which encounters the blocking plate 126 to prevent counterclockwise movement thereof in the off position of FIG. 3. The dimple 134 restricts clockwise pivoting of the blocking plate 126 in FIG. 3 until a predetermined rotative force is applied to the blocking plate through the keyed tumbler 118.

The opening 54 to accommodate the leg portion 52 has a generally rectangular configuration with a longer and shorter dimension, with the longer dimension being aligned to be substantially parallel to the path of the arm portion 52, as indicated by double-headed arrow 68. The opening 54 is dimensioned to relatively closely conform to the path of the leg portion 52 as the release lever/paddle 18 is moved between its normal and release positions. There is sufficient clearance to prevent binding between the leg portion 52 and the wall 56. At the same time, the tolerance is close enough that there is a limited space for foreign matter to migrate through the wall 56. The opening 54 is provided adjacent to the top of the receptacle 24 so that water and other foreign matter tends to move away therefrom under the force of gravity.

A gasket 144, that is preferably formed as one piece, is provided to seal the opening 54 around the leg portion 52. Preferably the gasket 144 extends completely around the leg portion 52, although the invention contemplates arrangements wherein the gasket 144 extends less than completely around the leg portion 52. The leg 50 defines a shoulder 146 with first and second portions 147, 147' that project oppositely away from the leg portion 52 and bridge the longer dimension of the opening 54 and capture the gasket 144 against the forwardly facing wall 56. With this arrangement, the opening 54 is fully covered by the gasket 144 which is preferably compressed by the shoulder 146 at both horizontally spaced ends 150, 152 of the opening 54. The gasket is preferably secured, as by an adhesive, to the leg 50.

The shoulder 146 serves the dual purpose of capturing the gasket 144 and also limiting the movement of the paddle moving from its release position back into its normal position under the force of the spring 114.

In one form, the gasket 144 is made from a foam material. Other compressible materials which will create a suitable seal are contemplated by the invention.

The foregoing disclosure of specific embodiments is intended to be illustrative of the broad concepts comprehended by the invention.

I claim:

1. A latch assembly for releasably holding a strike element, said latch assembly comprising:

a release lever;

a housing having a body defining a receptacle for the release lever and having a wall bounding the receptacle, there being an opening in the wall;

means for mounting the release lever to the housing for movement relative to the housing between a) a normal position and b) a release position;

latch means on the housing for cooperating with a strike element and movable selectively relative to the housing between a) a latched position wherein the latch means will hold a strike element and b) an unlatched position wherein a strike element held by the latch means with the latch means in its locked position can be released from the latch means;

means operatively connecting between the release lever and the latch means for moving the latch means from its latched position into its unlatched position as an incident of the release lever moving from its normal position into its release position, said connecting means including a leg extending through the opening in the body wall, said leg being defined at least in part from a flat material having a first thickness, said leg having an associated shoulder including at least first and second parts projecting oppositely away from the leg, said opening having a width that is only slightly wider than the first thickness and a length sufficient to accommodate movement of the leg as the release lever moves between its normal and release positions; and means for at least partially sealing the opening to avoid the passage of foreign matter through the body opening, said sealing means having at least a portion that is located between each of the first and second parts of the shoulder and the body with the release lever in at least one of its normal and release positions.

2. The latch assembly according to claim 1 wherein the sealing means comprises a gasket that is compressed between the shoulder and the body with the release lever in its normal position and the shoulder has a length and a width with the width being approximately equal to the first thickness;

3. The latch assembly according to claim 1 wherein the leg is unitary with the release lever to follow movement of the release lever at all times as the release lever moves between its normal and release positions.

4. The latch assembly according to claim 3 wherein the release lever and leg are formed as one piece.

5. The latch assembly according to claim 1 wherein the body has a top and bottom, the leg moves in a path as the release lever moves between its normal and release positions and the body wall opening is substantially matched to the path of the leg where the leg coincides with the body wall as the release lever moves between its normal and release positions and is closer to the top of the body than it to the bottom of the body.

6. The latch assembly according to claim 5 wherein the path is substantially straight and extends in a first line and the body wall opening is substantially rectangular with a longer and a shorter dimension and the longer opening dimension is aligned with the first line.

7. The latch assembly according to claim 1 wherein the sealing means comprises a gasket that completely surrounds a portion of the leg.

8. The latch assembly according to claim 7 wherein the gasket is made from a foam material.

9. The latch assembly according to claim 1 wherein the shoulder abuts the body to limit movement of the release lever as it moves from its release position into its normal position.

10. The latch assembly according to claim 1 wherein the means for mounting the release lever mounts the release lever for pivoting movement about a first axis.

11. The latch assembly according to claim 10 wherein the connecting means includes a pivot plate that is pivotable between first and second positions about a second axis that is transverse to the first axis.

12. The latch assembly according to claim 11 wherein the leg acts directly against the pivot plate.

13. The latch assembly according to claim 11 including lock means on the body for selectively blocking the pivot plate in one of its first and second positions.

14. The latch assembly according to claim 6 wherein the shoulder is elongate and the first and second parts thereof bridge the longer dimension of the opening.

15. A latch assembly for releasably holding a strike element, said latch assembly comprising:

a housing having a body defining a cup-shaped forwardly opening receptacle bounded by a forwardly facing wall with there being an elongate through opening in the forwardly facing wall;

a release lever received at least partially within the receptacle and mounted to the housing for movement relative thereto between a) a normal position and b) a release position;

latch means on the housing for cooperating with a strike element and movable selectively relative to the housing between a) a latched position wherein the latch means will hold a strike element and b) an unlatched position wherein a strike element held by the latch means with the latch means in its locked position can be released from the latch means;

means operatively connecting between the release lever and the latch means for moving the latch means from its latched position into its unlatched position as an incident of the release lever moving from its normal position into its release position, said connecting means including a leg on the release lever formed as one piece with the release lever and extending through the opening in the housing, said leg having a longer dimension and a shorter dimension taken transversely to its length, said connecting means further including a plate that is mounted to the housing for movement between first and second positions;

there further being means cooperating between the leg and plate for moving the plate from its first position into its second position as an incident of the release lever moving from its normal position into its release position;

there being means cooperating between the plate and latch means for moving the latch means from its latched position into its unlatched position as an incident of the plate moving from its first position into its second position; and means between the housing and at least one of the leg and release lever for sealing at least a port of the body opening to avoid the passage of foreign matter through the body opening, said through opening having a width that is slightly longer than the shorter dimension of the leg.

16. The latch assembly according to claim 15 wherein the sealing means comprises a gasket attached to at least one of the leg, the release lever and housing and the release lever and leg are defined by a formed piece of sheet material.

17. The latch assembly according to claim 16 wherein the gasket surrounds the leg and is compressed between the leg and the housing with the release lever in its normal position.

18. The latch assembly according to claim 17 wherein the leg has a rearwardly facing shoulder and the gasket is compressed between the forwardly facing wall of the body and the rearwardly facing shoulder.

19. The latch assembly according to claim 18 wherein the shoulder abuts the body to limit movement of the release lever as it moves from its release position into its normal position, the body has a top and a bottom, and the through opening is closer to the top of the body than it is to the bottom of the body.

20. The latch assembly according to claim 19 wherein the shoulder bridges the opening in the wall.

* * * * *